US006540076B1

(12) United States Patent
Elia et al.

(10) Patent No.: US 6,540,076 B1
(45) Date of Patent: Apr. 1, 2003

(54) DISPENSING CARTON FOR METAL-BACKED PRINTING BLANKET

(75) Inventors: John Rocco Elia, Arden, NC (US); Darren Reed McCracken, Clyde, NC (US); Thomas Gerald Ferguson, Waynesville, NC (US)

(73) Assignee: Day International, Inc., Dayton, OH (US)

( * ) Notice: Subject to any disclaimer, the term of this patent is extended or adjusted under 35 U.S.C. 154(b) by 0 days.

(21) Appl. No.: 09/860,087

(22) Filed: May 17, 2001

(51) Int. Cl.[7] ..... B65D 85/67

(52) U.S. Cl. ..... 206/396; 206/409; 206/459.5; 225/48; 242/588.4

(58) Field of Search ..... 206/395–397, 206/408, 409, 459.5; 225/42, 43, 80, 90, 47, 48; 242/588.4

(56) References Cited

U.S. PATENT DOCUMENTS

| | | | | | |
|---|---|---|---|---|---|
| 1,729,432 | A | * | 9/1929 | Anderson | 225/47 |
| 2,743,009 | A | * | 4/1956 | Williamson et al. | 206/396 |
| 2,935,192 | A | * | 5/1960 | De Million-Czarnecki | 206/396 |
| 3,246,742 | A | * | 4/1966 | Coe | 206/396 |
| 3,477,624 | A | * | 11/1969 | Branyon et al. | 225/43 |
| 3,944,072 | A | | 3/1976 | Budington et al. | |
| D249,641 | S | | 9/1978 | Dali | |
| 4,197,962 | A | | 4/1980 | Edwards | |
| 4,274,573 | A | * | 6/1981 | Finkelstein | 206/409 |
| 4,471,904 | A | | 9/1984 | Cassidy | |
| 4,673,125 | A | | 6/1987 | Weaver | |
| 4,714,191 | A | | 12/1987 | Richardson | |
| 5,014,906 | A | | 5/1991 | Gero | |
| 5,150,789 | A | | 9/1992 | Bass | |
| 5,174,492 | A | | 12/1992 | Gero | |
| 5,243,807 | A | | 9/1993 | Randlett | |
| 5,511,663 | A | * | 4/1996 | Shimura et al. | 206/395 |
| 5,819,935 | A | * | 10/1998 | Lawson | 206/408 |

FOREIGN PATENT DOCUMENTS

| | | | | |
|---|---|---|---|---|
| JP | 6-239338 | * | 8/1994 | 225/43 |

* cited by examiner

*Primary Examiner*—Bryon P. Gehman
(74) *Attorney, Agent, or Firm*—Killworth, Gottman Hagan & Schaeff LLP

(57) ABSTRACT

A carton is provided for packaging, shipping, and dispensing a metal-backed printing blanket onto a printing press cylinder in a controlled fashion. A lengthwise slit or opening can easily be formed in a panel of the carton from which only an end of the metal-backed printing blanket may be removed. Parallel reference lines may also be included on the carton which permit alignment marks to be drawn on the printing blanket such that it may be properly inserted into a locking device of the printing press cylinder. Graspable sides of the carton facilitate tension and alignment control as the printing blanket is dispensed onto the cylinder.

26 Claims, 5 Drawing Sheets

DISPENSING CARTON FOR METAL-BACKED PRINTING BLANKET

BACKGROUND OF THE INVENTION

This invention relates to a carton blank and carton for packaging and dispensing a printing blanket, and more particularly to a carton which permits the alignment and controlled feeding of a metal-backed printing blanket onto a rotating print cylinder of a printing press.

The most common commercial printing process is offset lithography. In this printing process, ink is offset from a printing plate to a rubber blanket mounted on a cylinder before being transferred to a substrate, such as paper. Typically, the cylinder comprises a metal cylinder having an encircling rubber printing blanket which is releasably mounted to the cylinder. The rubber printing blanket may be reinforced with either a cloth back or a metal back. Unlike the cloth back, the metal back adds durability to the carried rubber layer(s) on the blanket by removing stress which occurs from tensioning the printing blanket as it is mounted on the metal is cylinder.

However, with a cloth back the printing blanket may be rolled upon removal from its shipping carton and maintained as a roll by finger pressure. This minimal amount of handling pressure permits two operators to easily align the blanket in a locking device which is typically located in a longitudinal gap in the metal cylinder. Additionally, as the cylinder rotates to mount the blanket thereon, the operators can easily control the tension and alignment of the unrolling blanket with such minimal handling pressure.

With a metal-backed printing blanket, the metal sheet strongly desires to uncoil upon removal from a conventional shipping carton. The handling pressure needed to maintain the metal-backed blanket as a coil makes it difficult for the operators to properly insert and align the blanket into the locking device of the cylinder. Additionally, the resistance of the blanket to being coiled makes it difficult to control the tension and alignment of the blanket as it unrolls onto the rotating cylinder. Such problems have resulted in a high percentage of ruined metal-backed blankets due to improper installation.

Accordingly, there is a need in the printing industry for an improved procedure or device which maintains the coiled condition of the blanket and permits the dispensing of a metal-backed printing blanket to a print cylinder in a controlled fashion.

SUMMARY OF THE INVENTION

The above-mentioned needs are met by the present invention in which a shipping carton for a metal-backed printing blanket is provided. The shipping carton is adapted to permit the proper loading of the blanket onto a printing press cylinder. As it will appear in the more detailed description and drawings, the carton provides for the formation of a lengthwise slit from which to dispense the enclosed blanket in a controlled fashion. The shape of the carton may vary, and encompasses any common geometrical shape including rectangular, triangular, cylindrical, and the like.

In a first embodiment, the carton is substantially rectangular in shape, is formed preferably from a one piece blank of retail packaging type cardboard, and has from one end of the blank to the other first, second, third, fourth, and fifth panels. The first and fifth panels are folded from the second and fourth panels, respectively, so that the first panel lies substantially parallel to and outside the fifth panel with its edge secured adjacently to the fourth panel. Pull tabs are provided in the third panel in order to permit the formation of a lengthwise slit adjacent the edge of the third panel by an operator. The slit once formed, permits the mounting end of the metal-backed printing blanket to be removed from the carton. Reference lines are also optionally provided on the third panel. These reference lines may be used to draw alignment marks on a dispensed portion of the printing blanket for proper insertion into a locking device of the blanket cylinder.

All but the third panel have pairs of flaps together forming the two sides of the carton. In particular, the fourth panel includes a pair of doubled-winged flaps having handholds. Each double-winged flap comprises a body foldably attached between inner and outer flaps. The body forms a space between the inner and outer flaps when the outer flap is folded over the inner flap. All the flaps of the carton together help to form strong handholds in the sides of the carton. The handholds permit two operators to have control of the blanket for tension and proper alignment as the blanket is fed out of the carton and mounted on a rotating cylinder.

In second and third embodiments of the present invention, the carton is provided in the form of a cylindrical tube and a triangular tube, respectively. In these embodiments, the mounting end of the rolled blanket is still dispensed through a side wall of the carton. Handles and/or indentations are also provided such that the carton may be easily gripped to facilitate control over the alignment and tension of a dispensing blanket from the carton onto a rotating blanket cylinder. Alignment marks may additionally be provided to each of these embodiments.

In accordance with one aspect of the present invention, provided is a carton blank for a carton to contain a metal-backed printing blanket in a roll and from which to dispense the blanket. The blank comprises at least first, second, and third panels in the order named from one end of the blank to the other and foldable with respect to each other, one of the panels being capable of dispensing the blanket in a controlled fashion, and at least one of the panels having a pair of side flaps to form sides of the carton.

In accordance with another aspect of the present invention, provided is a carton to contain a metal-backed printing blanket in a roll, the carton comprising at least one panel through which to dispense the printing blanket.

In accordance with yet another aspect of the present invention, provided is a carton to contain a metal-backed printing blanket in a roll and from which to dispense the printing blanket. The carton comprises first, second, third, fourth, fifth, and side panels in which a lower edge of the first panel is secured to the fifth panel. Pull tabs for forming a lengthwise slit in the carton are provided generally in the plane of the third panel.

In accordance with still another aspect of the present invention, provided is a method of mounting a rolled printing blanket to a blanket cylinder in a printing press. The method comprises the steps of providing a carton containing the rolled printing blanket, opening a slit lengthwise in the carton to withdraw a mounting end of the printing blanket, and securing the mounting end in a locking device of the cylinder. The method further includes rotating the cylinder, and controlling the alignment and tension of the printing blanket as it mounts on the rotating cylinder until the printing blanket is completely dispensed from the carton.

These, and other features and advantages of the present invention will become apparent from the following detailed description, the accompanying drawings, and the appended claims.

DETAILED DESCRIPTION OF THE PREFERRED EMBODIMENT

Figure 1:
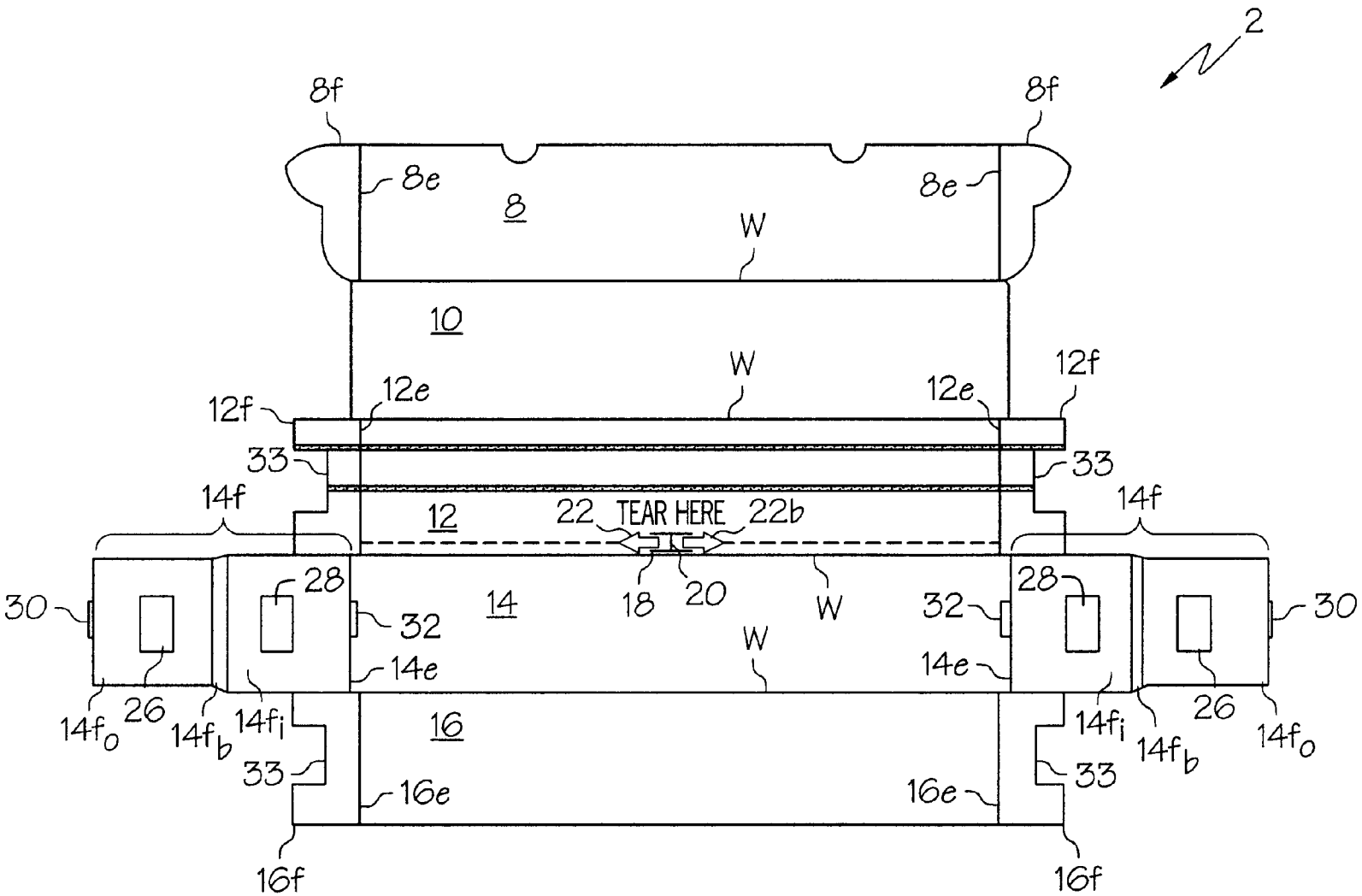
FIG. 1 is a view of an exterior side of a carton blank laid out flat.
Figure 2:
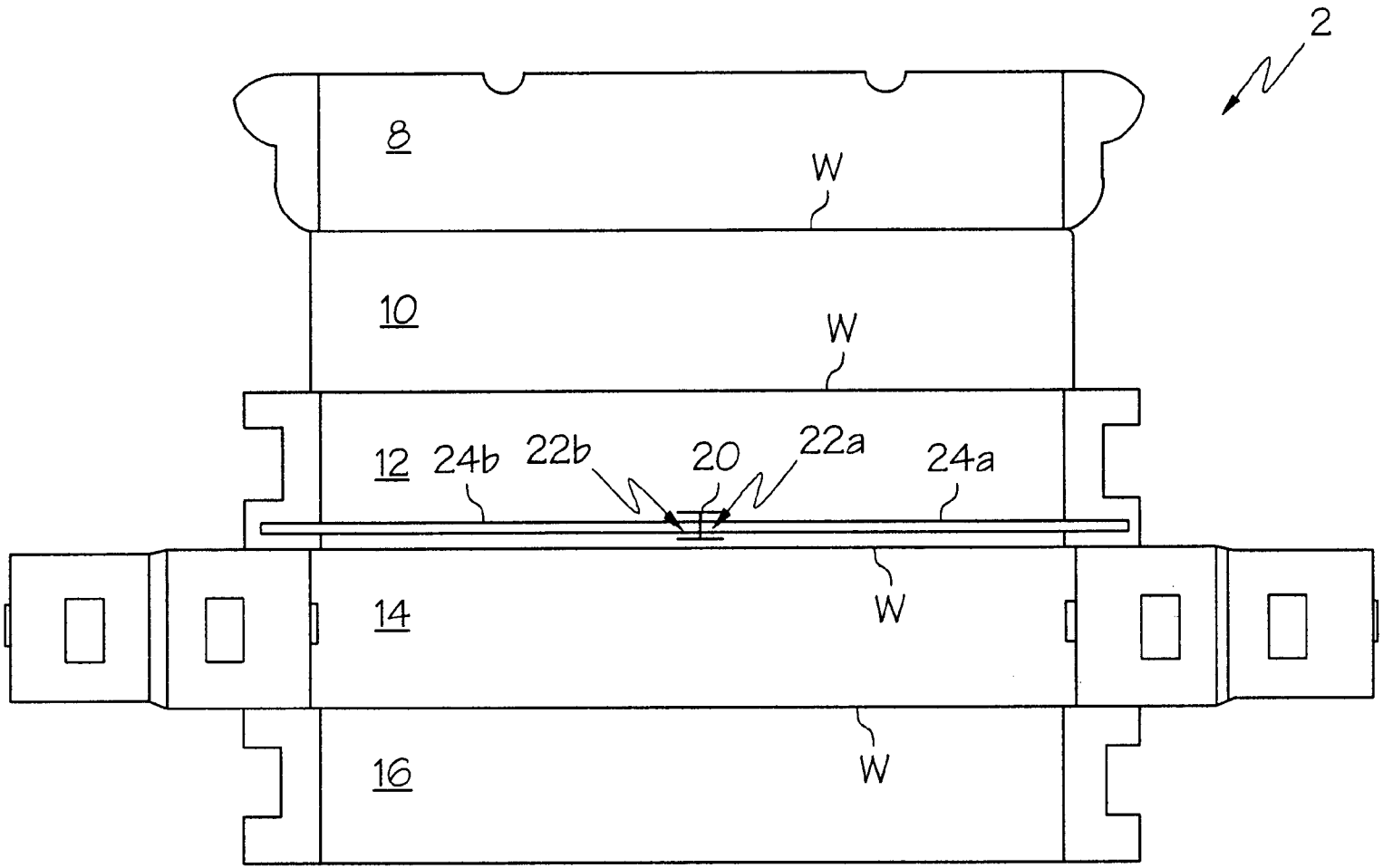
FIG. 2 is a view of an interior side of the carton blank of FIG. 1 laid out flat.

A carton blank is denoted by the numeral 2 in FIGS. 1 and 2 for making a carton, indicated by the numeral 4 in FIGS. 3–6. The carton 4 is specifically developed and is particularly well adapted for packaging, shipping, and dispensing in a controlled fashion, a rolled printing blanket which functions as a replaceable layer to a blanket cylinder on a printing press. A rolled printing blanket is designated by the letter "R" in FIGS. 3–8. The construction of the printing blanket, other than having a metal backing or base layer, is not important to an understanding of the invention. Printing blanket constructions are known in the art.

FIG. 1 shows the exterior side of the blank 2, and FIG. 2 shows the interior side thereof. Although the carton blank 2 is preferably a single piece, it should be apparent to those persons skilled in the art that the carton blank could be formed by assembling (glued, stapled, etc.) several pieces together. Additionally, although the preferred carton blank 2 comprises five panels with four pairs of flaps, as will be explained hereafter, it is to be appreciated that other blank designs, such for example as one that has four panels or another with at least one pair of flaps to form the sides, may be used as the dispensing carton for a metal-backed printing blanket without departing from the scope and spirit of the present invention. Furthermore, although cardboard is preferred, it should be apparent to those persons skilled in the art that other corrugated and noncorrugated materials such as, and not limited to, paperboard, plastics, and metal could be used to form a carton according to the present invention.

Referring particularly to FIG. 1, the blank 2 has a first panel 8, a second panel 10, a third panel 12, a fourth panel 14, and a fifth panel 16, and for convenience, are named in order from one end of the blank to the other. The panels are foldable with respect to each other along lines of weakness W.

The third panel 12 includes a pair of opposed score lines 18, i.e., perforations, and a generally vertical cut 20 extending there between which together form a pair of pull tabs 22*a* and 22*b*. As such, the pull tabs 22*a* and 22*b* are disposed generally within the plane of the third panel 12. As shown in FIG. 2 the pull tabs 22*a* and 22*b* on the interior side of the blank 2 are secured to a respective end of an adhesive strip 24*a* and 24*b*. The adhesive strips 24*a* and 24*b* are secured to the interior side and run substantially the full length of the third panel adjacent the line of weakness W that is between the third panel 12 and the fourth panel 14. The use of the adhesive strip will be explained further in a later discussion in reference to FIG. 3.

As shown in FIG. 1, each of the first, third, fourth and fifth panels 8, 12, 14 and 16 have a pair of side flaps 8*f*, 12*f*, 14*f* and 16*f* which is foldably attached to its side edges 8*e*, 12*e*, 14*e* and 16*e*. Each side flap 14*f* of the fourth panel 14 is a double-winged flap having an outer flap $\mathbf{14}f_0$, an inner flap $\mathbf{14}f_i$, and a body $\mathbf{14}f_b$. The body is foldably attached to both the outer and inner flaps along its edges, and creates a space between the outer and inner flaps when folded over each other. Each outer flap $\mathbf{14}f_o$ includes a hand hole 26, which is sized to permit an associated hand flap 28 provided on the inner flap $\mathbf{14}f_i$ to fold into when the inner and outer flaps are folded over and the hand flap is pushed inwards by an operator's hand. A tab 30 provided at the end of each outer flap $\mathbf{14}f_o$, engages in a tab hole 32 which secures the outer flap $\mathbf{14}f_o$ folded over the interior side of the inner flap $\mathbf{14}f_i$. Accordingly, the pairs of side flaps 8*f*, 12*f*, 14*f*, and 16*f* overlap each other to form sides 34 (FIG. 3) of the carton 4. It is to be appreciated that the overlapping of the side flaps 8*f*, 12*f*, 14*f*, and 16*f*, and the sizing of the hand hole 26 and hand flap 28 form a pair of durable handholds 36 (FIG. 3) which an operator may securely grasp for control of the carton 4. The pairs of flaps 12*f* and 16*f* of the third and fifth panels 12, 16, respectively, have cutouts 33 so not to block the handholds 36. Additionally, the side flaps 8*f* of the first panel 8 are shaped such that they also do not block the handhold 36 when positioned in the sides 34 of the formed carton 4 as will be explained hereafter.

Figure 3:
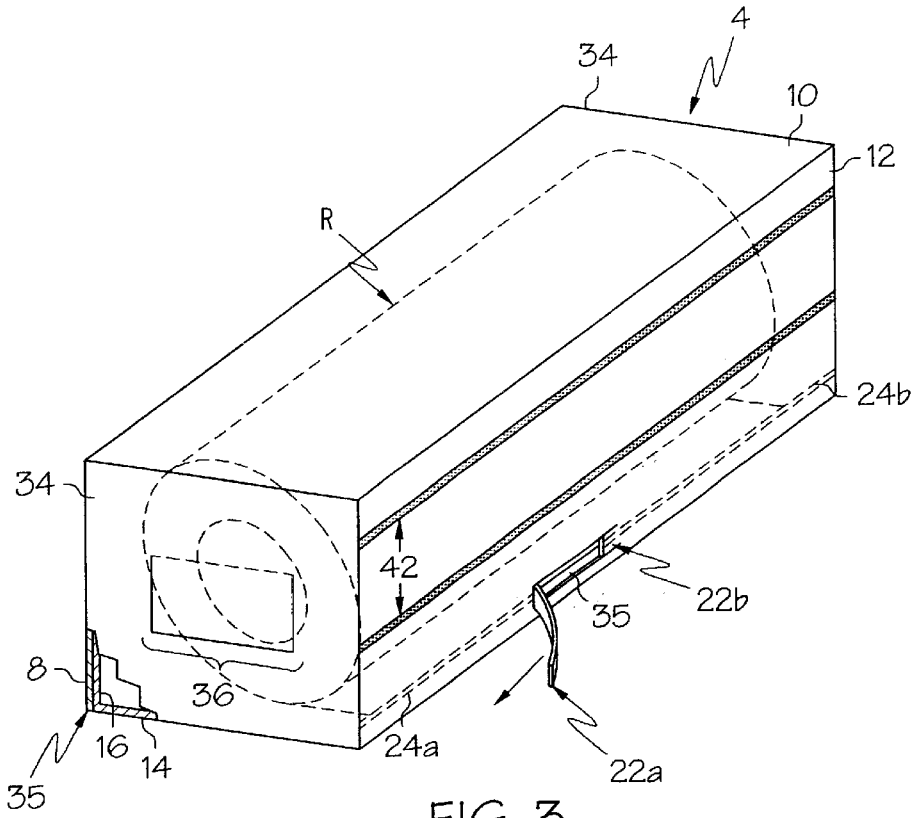
FIG. 3 is a perspective view of an assembled carton, partially cut away, containing a rolled metal-backed printing blanket ready to be dispensed from the carton, and with a pull tab partially removed.

To form the carton 4 into an erected boxlike condition that is illustrated in FIG. 3, flaps 12*f* and 16*f* are folded toward the interior side of the blank 2 and on each side, and the flaps of the third and fifth panels 12, 16 are brought together end-to-end. At this point in the assembly of the carton, the third panel 12 and the fifth panel 16 are standing perpendicular to the fourth panel 14. Next, on each side of the carton 4, the outer flap $\mathbf{14}f_o$ of the fourth panel 14 is folded over both its inner flap $\mathbf{14}f_i$ and the touching flaps 12*f* and 16*f*, and secured inward of these flaps by inserting its tab 30 into the associated tab hole 32. This arrangement forms an open box, and after placing a rolled printing blanket R therein, the first panel 8 is folded in parallel over the fifth panel 16 closing the opening with the second panel 10. The flaps 8*f* of the first panel 8 are then inserted between the inner flaps $\mathbf{14}f_i$ of the fourth panel 14 and the flaps 16*f* of the fifth panel 16 to complete the sides 34. A lower edge 35 of the first panel 8 is secured adjacently an edge of the fifth panel 16 in any conventional fashion such as gluing or taping to complete the erected carton 4 as seen in FIG. 3.

When an operator wants to dispense the rolled metal-backed printing blanket R for the purpose of mounting it to a blanket cylinder, the operator first opens the carton 4 by pulling on the provided pull tabs 22*a* and 22*b*, which is illustrated in FIG. 3 showing pull tab 22*a* being partially removed. Removing the pull tabs 22*a* and 22*b* pulls the adhesive strips 24*a* and 24*b* (FIG. 2) through the interior side of the third panel 12, tearing a lengthwise slit 38 in the carton 4.

Figure 4:
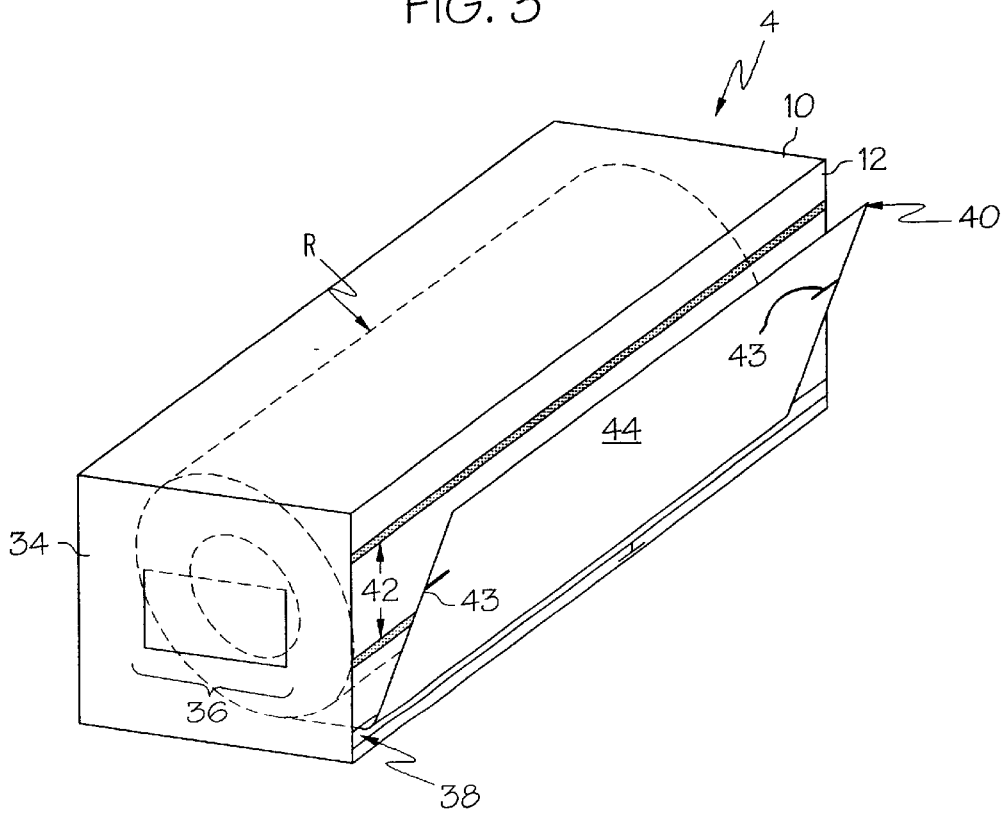
FIG. 4 is a perspective view of the carton with pull tabs removed from a third panel and a portion of the metal-backed printing blanket dispensed from the carton such that the blanket may be marked with reference to alignment lines provide on the third panel.
Figure 5:
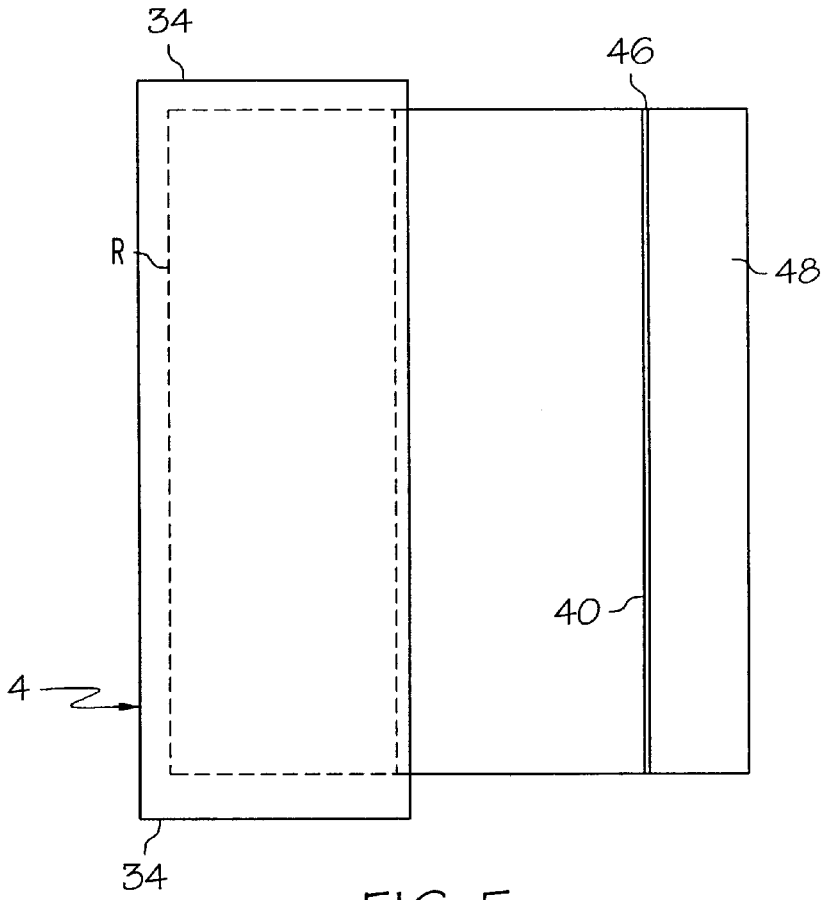
FIG. 5 is a top plan view of the opened carton with a mounting end of the printing blanket being aligned and secured to a print cylinder.
Figure 6:
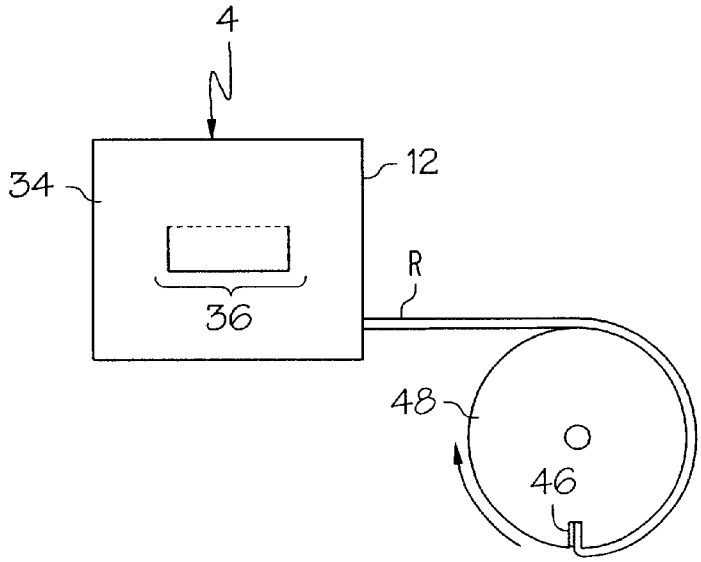
FIG. 6 is a side view of the carton showing the printing blanket as it is dispensed from the carton in a controlled fashion.

As illustrated in FIG. 4, showing a perspective view of the carton with the pull tabs 22*a* and 22*b* removed from the third panel 12, through the lengthwise slit 38 a mounting end 40 of the rolled printing blanket R is then drawn from the carton 4. A pair of parallel lines 42 are optionally provided on the exterior side of the third panel 12 and may be used as a quick reference to make alignment marks 43 adjacent the mounting end 40 on a rear surface 44 of the printing blanket R. With such an alignment marks 43, the printing blanket R may be placed properly within a locking device 46 of a blanket cylinder 48, which is shown in FIGS. 5 and 6. Preferably, the parallel lines are spaced apart an amount by which the mounting end 40 of the printing blanket R is inserted into the locking device 46. Typically, this amount is about 3" inches (7 to 8 cm).

After making alignment marks, the mounting end 40 of the printing blanket is aligned and secured to the locking device 46 in the blanket cylinder 48 which is illustrated in FIG. 5 showing a top plan view thereof. Once the mounting end 40 of the printing blanket R is properly locked in place, the cylinder 48 is then rotated which dispenses the remaining portion of the rolled printing blanket from the carton 4. As the printing blanket R is dispensed from the carton 4, it is mounted to the blanket cylinder 48 as illustrated in FIG. 6. It is to be appreciated that because the operators do not have to concern themselves with maintaining the printing blanket in a roll, as the print cylinder 48 rotates, the tension and alignment of the printing blanket R is easily controlled by the operators using the provided handholds 36 until the printing blanket is completely dispensed from the carton 4. Additionally, dispensing the metal-backed printing blanket from the carton 4 minimizes the risk of damage to the blanket from misalignment.

Figure 7:
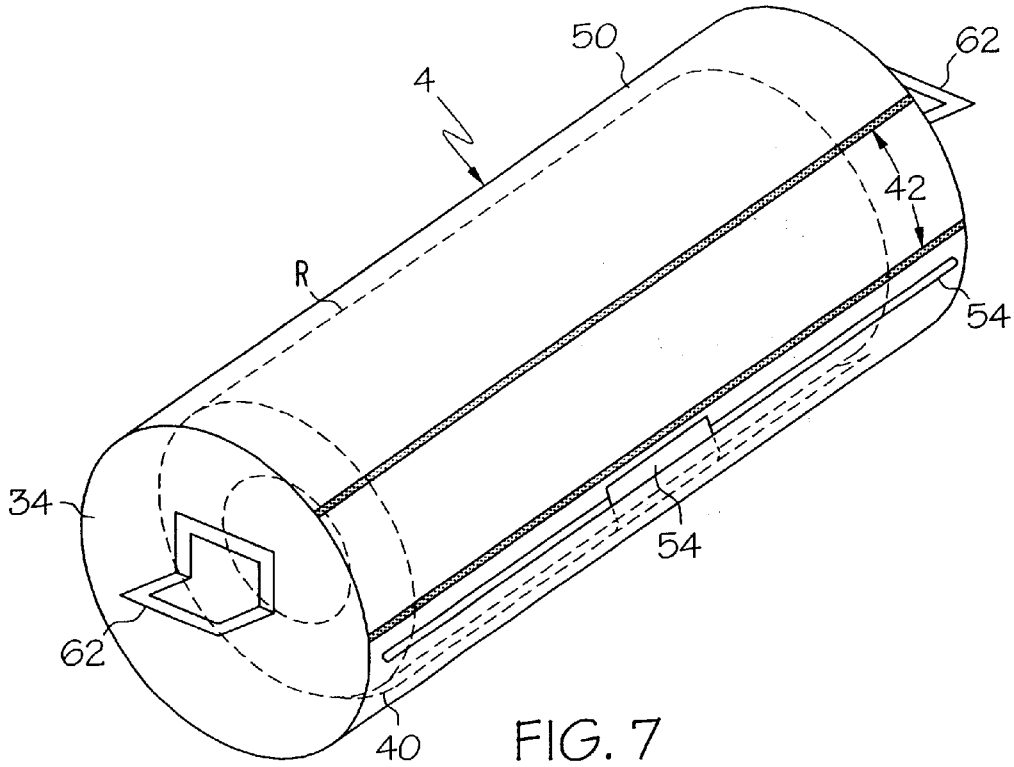
FIG. 7 is a perspective view of an alternative embodiment of a carton according to the present invention.
Figure 8:
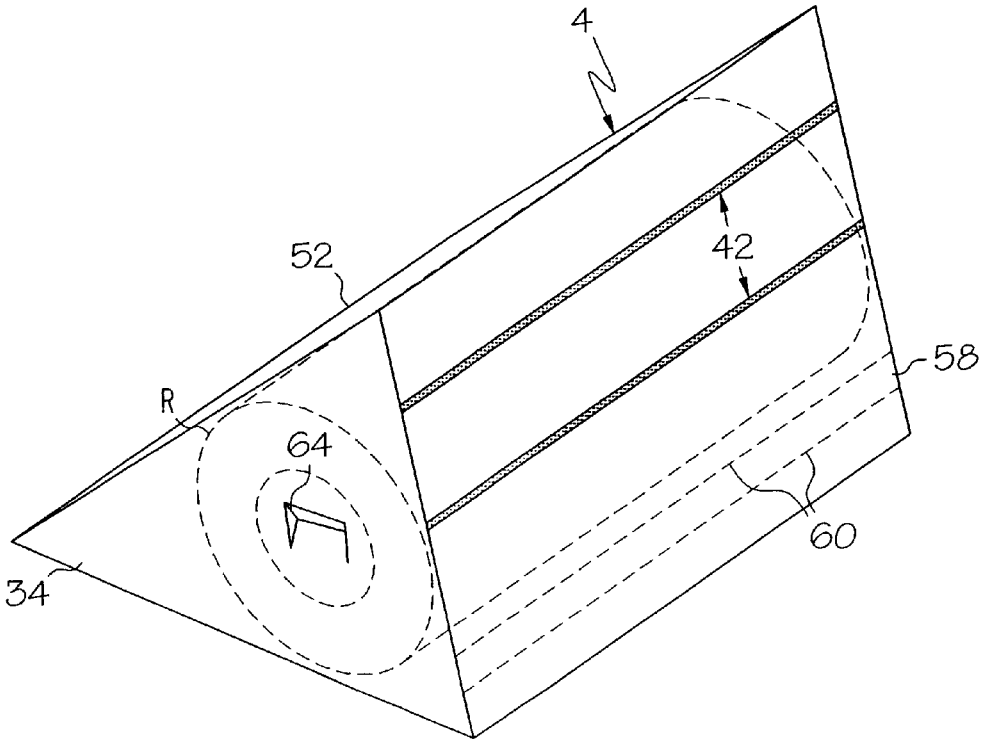
FIG. 8 is a perspective view of another alternative embodiment of a carton according to the present invention.

It is to be appreciated that the above method of dispensing the rolled metal-backed printing blanket R is applicable to cartons of other shapes. For example, as illustrated in FIG. 7, the carton 4, alternatively, may be formed in the shaped of a cylindrical tube 50 which is sized to contain the rolled blanket R. In this embodiment, the sides 34 may be formed of inserts or caps that seal up the ends of the cylinder tube 50. In still another alternative embodiment, the carton 4 may be shaped in the form of a triangular-shaped box 52 which also sized to contain the rolled blanket R as illustrated in FIG. 8. Accordingly, the carton may be any box shape from which to dispense the rolled blanket R in a controlled fashion.

Additionally, other means for providing a lengthwise slit/opening in the carton 4 may be provided without departing from the scope and spirit of the present invention. For example, as illustrated in FIG. 7, an opening 54 may be provided. For shipping, the opening 54 could be sealed with a removable plug, or covered with plastic, metal foil, and/or tape. A dispensing tab 56 may be provided which has a first end portion exposed through the opening, and a second end portion attached to the mounting end 40 of the rolled blanket R. Accordingly, the dispensing tab 54 would be used to help guide and extract the mounting end 40 of the rolled blanket R through the opening 54. Another example is illustrated by FIG. 8, wherein an opening in the carton 4 may be formed by a punch-out section 58 formed by perforations 60. Furthermore, as illustrated in FIG. 7, handles 62 may be provided on the sides 34 of the carton 4. Moreover, as shown in FIG. 8, an indentations 64 sized to be easily gripped by an operator's hand may be provided in each side 34 without departing from the scope and spirit of the present invention. What is important is that the sides 34 of the carton 4 be graspable in order to easily control the alignment and tension of a dispensing blanket onto a rotating cylinder. In both these alternative embodiments of FIGS. 7 and 8, reference lines 42 may optionally be provided.

While certain representative embodiments and details have been shown for purposes of illustrating the invention, it will be apparent to those persons skilled in the art that various changes in the methods and apparatus disclosed herein may be made without departing from the scope of the invention.

What is claimed is:

1. A carton blank for a carton to contain a metal-backed printing blanket in a roll and from which to dispense the blanket directly to a print roller for installation thereon, said blank comprising:

at least first, second, and third panels in the order named from one end of the blank to the other and foldable with respect to each other, one of said panels having means to permit dispensing of the blanket therethrough;

at least one of said panels having a pair of side flaps to form sides of the carton; and a pair of parallel lines provided on an exterior side of the blank and space from said dispensing means to provide a reference for aligning the blanket during installation to the print roller.

2. A carton blank as set forth in claim 1 further comprising a fourth panel which is foldable with respect to said third panel.

3. A carton blank as set forth in claim 2 further comprising a fifth panel which is foldable with respect to said fourth panel.

4. A carton blank as set forth in claim 3 in which each of said first, third, fourth, and fifth panels has a pair of side flaps.

5. A carton blank as set forth in claim 4 in which each of said side flaps of said third and fifth panels has a cutout.

6. A carton blank as set forth in claim 1 in which said panel adapted to permit dispensing of the blanket comprises a pair of pull tabs adapted to open a lengthwise slit in the carton.

7. A carton blank as set forth in claim 1 in which said pair of parallel lines are spaced three inches apart.

8. A carton formed from the blank as set forth in claim 1.

9. A carton blank for a carton to contain a metal-backed printing blanket in a roll and from which to dispense the blanket, said blank comprising:

at least first, second and third panels in the order named from one end of the blank to the other and foldable with respect to each other, one of said panels having means capable of dispensing the blanket in a controlled fashion, wherein:

at least one of said panels has a pair of side flaps to form sides of said carton;

said panel capable of dispensing the blanket includes a pair of pull tabs that open a lengthwise slit in said carton; and each of said pull tabs is secured to an adhesive strip provided on an interior side of said blank for tearing said lengthwise slit.

10. A carton blank for a carton to contain a metal-backed printing blanket in a roll and from which to dispense the blanket, said blank comprising:

at least first, second, third, fourth, and fifth panels in the order named from one end of the blank to the other and foldable with respect to each other, one of said panels having means capable of dispensing the blanket in a controlled fashion, wherein:

each of said first, third, fourth, and fifth panels has a pair of side flaps to form sides of the carton; and each of said side flaps of said fourth panel has a body foldably attached between an inner and outer flap, said outer flap has a hand hole and tab, and said inner flap has a hand flap.

11. A carton blank as set forth in claim 10 in which said fourth panel has a tab cutout, said tab being securable in said tab cutout.

12. A carton to contain a metal-backed printing blanket in a roll and to dispense the printing blanket directly to a print roller during installation thereon, said carton comprising:

a pair of side panels;

a panel having means to permit dispensing of the printing blanket therethrough, said panel forming a cylindrical tube and said side panels each closing a respective end of said cylindrical tube; and a pair of parallel lines provided on an exterior side of said panel and spaced from said dispensing means provide a reference for aligning the blanket during installation to the print roller.

13. A carton as set forth in claim 12 in which said panel comprises pulled tabs adapted to form a lengthwise slit in said panel.

14. A carton as set forth in claim 12 in which said panel comprises means for forming a lengthwise opening through which to dispense the blanket, said means is selected from the group consisting of a cutout, a cover, and a plug.

15. A carton as set forth in claim 12 in which said sides have means capable of being easily grasped.

16. A carton as set forth in claim 15 further comprising indentations provided in said sides.

17. A carton to contain a metal-backed printing blanket in a roll and from which to dispense the printing blanket directly to a print roller during installation thereon, said carton comprising:

first, second, third, fourth, fifth, and side panels;

a lower edge of said first panel secured to said fifth panel;

pull tabs for forming a lengthwise slit in said carton provided generally in the plane of said third panel; and a pair of parallel lines provided on an exterior side of said third panel and spaced from said dispensing means to provide a reference for aligning the blanket during installation to the print roller.

18. A carton as set forth in claim 17 further comprising a pair of handholds provided in said side panels.

19. A carton as set forth in claim 17 formed from a one piece carton blank.

20. A carton as set forth in claim 17 in which the said side panels are formed by at least one pair of flaps attached to at least one of said first, third, fourth and fifth panels.

21. A carton as set forth in claim 17 in which the said side panels are formed by a pair of flaps attached to said fourth panel and at least one other pair of flaps attached to one of said first, third and fifth panels and overlapped by said pair of flaps of said fourth panel.

22. A carton as set forth in claim 17 containing a metal-backed printing blanket in a roll.

23. A carton to contain a metal-backed printing blanket in a roll and from which to dispense the printing blanket, said carton comprising:

first, second, third, fourth, fifth, and side panels, said fourth panel having a pair of tab cutouts and an attached pair of double-winged flaps which define said side panels, and said double-winged flaps having a pair of tabs engageable in said pair of tab cutouts and a pair of handholds;

a lower edge of said first panel secured to said fifth panel; and pull tabs for forming a lengthwise slit in said carton provided generally in the plane of said third panel.

24. A carton as set forth in claim 23 in which said side panel is further defined by a pair of flaps attached to each of said first, third, and fifth panels, said pairs of flaps of said first, third, and fifth panels being overlapped by said double-winged flaps of said fourth panel.

25. A carton as set forth in claim 24 in which said pairs of flaps of said first, third, and fifth panels are shaped not to block said handholds.

26. A dispensing carton for a print roller, comprising:

a metal-backed printing blanket in a roll;

at least first, second, and third panels in the order named from one end of said blank to the other and foldable with respect to each other, one of said panels having means to permit dispensing of said blanket therethrough in a controlled fashion;

at least one of said panels having a pair of side flaps to form sides of the carton; and a pair of parallel lines provided on an exterior side of said dispensing carton and spaced from said dispensing means to provide a reference for aligning said blanket to the print roller during installation thereon.

* * * * *